US005295882A

United States Patent [19]

McDermott

[11] Patent Number: 5,295,882

[45] Date of Patent: Mar. 22, 1994

[54] MARINE SIGNAL DEVICE

[76] Inventor: Kevin McDermott, 196 Phillips Dr., Hampstead, Md. 21074

[21] Appl. No.: 953,754

[22] Filed: Sep. 29, 1992

Related U.S. Application Data

[63] Continuation of Ser. No. 726,771, Jul. 8, 1991, abandoned.

[51] Int. Cl.[5] ..... B63C 9/20

[52] U.S. Cl. ..... 441/16

[58] Field of Search ..... 441/16-18

[56] References Cited

U.S. PATENT DOCUMENTS

| | | | |
|---|---|---|---|
| 2,346,695 | 4/1944 | Miller | 441/17 |
| 2,355,013 | 8/1944 | Rochestie . | |
| 2,366,929 | 1/1945 | Pfeil | 441/16 |
| 3,292,039 | 12/1966 | Horino | 441/17 X |
| 3,329,981 | 7/1967 | Orsino | 441/18 |
| 3,559,224 | 2/1971 | Shimizu | 441/17 |
| 3,605,149 | 9/1971 | Keats | 441/16 |
| 4,669,990 | 6/1987 | McDermott | 441/16 |

FOREIGN PATENT DOCUMENTS

| | | | |
|---|---|---|---|
| 454732 | 2/1949 | Canada | 441/17 |

*Primary Examiner*—Sherman Basinger

*Attorney, Agent, or Firm*—Eugene F. Osborne, Sr.

[57] ABSTRACT

A battery powered signaling device for the rescue of overboard swimmers is arranged in an elongated container in which reciprocal sliding batteries are used as ballast for the erection of the signaling elements above the water line; and further, upon deployed erection gravity supplemented by minor force of a conducting compressible spring that is always in contact with the uppermost positive battery terminal automatically forces the batteries downward to close an electric circuit by making contact between the negative casing of the bottommost battery and conductors leading to activate the signaling subsystem which is a lighting source in a preferred embodiment. When aboard ship, stowage of the signaling device in an inverted orientation permits gravity forces to slide the batteries downward to compress the conducting spring and open the electrical circuit by breaking contact between the battery negative case and the return conductors thereby automatically extinguishing the signal in a wide range of roll and pitch motions of the ship. An end cap, sealed against entry of water, is removable to allow withdrawal of the battery magazine for servicing as required.

21 Claims, 4 Drawing Sheets

MARINE SIGNAL DEVICE

This is a continuation of application Ser. No. 726,771, filed Jul. 08, 1991, now abandoned.

BACKGROUND OF THE INVENTION

1. Field of the Invention

This invention relates to a floating signal device used for marine rescue and safety applications. If a person falls overboard, the signal device, usually along with a life ring, is thrown to him. By swimming toward the signal, the person finds the life ring. Similarly, rescue boats find the overboard person by heading towards the signal.

2. Related Prior Art

As is known, a variety of devices have been in use. Typical of these devices is a marine safety light U.S. Pat. No. 2,355,013. This includes a tubular body, a lamp, an optically clear cover, a gravity actuated switching subassembly including a moving mercury switch element, a battery located in the lower portion of the tube and a supplemental weight frequently located below the battery. The device is normally stored in an inverted position and when its use is required, it is thrown into the water. The device is weighted so that once it is in the water, it rights itself with its lamp and clear lens cover above the water line. Furthermore, the gravity operated switching subassembly automatically energizes the lamp providing a visible distress signal. Similar nonvisual devices emit radio locator beacons which pinpoint its location.

The prior art also includes U.S. Pat. No. 4, 669,990, issued to applicant. To prevent premature excitation of the signal lamp, excessive wear and depletion of the signal battery supply with ship attitude or rise and fall due to wave action, the automatic activating switch incorporated a winding channeled maze to delay the travel of a solid metallic ball to the activating cavity where it bridges the electrical switch contacts to energize the lamp when the signal device is deployed in the water.

SUMMARY OF THE INVENTION

To improve the performance of the signal lamp, to enhance the reliability of operation, and to extend the operating lifetime of the signal in the shipboard environment the present invention employs a shock mounted lamp and an improved automatic activating switching mechanism. The lamp is supported in the tubular body by cellular foam, which, having a low specific gravity relative to water, improves the deployed stability of the device while guaranteeing buoyancy by preventing the tubular body from filling with water under all conditions. Automatic electric excitation of the lamp circuits on deployment in the water is effected by longitudinal movement of one or more batteries held in a cartridge clip or magazine, insertable within the tubular body of the device, so that when floating upright in the water the batteries descend by gravity to engage contacts completing the electrical circuit. When deployed upright in the water a spring in the electrical circuit located between the lamp and battery compartments assists in reducing contact resistance in the circuit and it combines with gravity forces in the movement of the batteries. Inactive ballast weight and separate attitude sensitive electrical switches are eliminated in this invention.

It is an object of this invention to provide a signal device which increases its effectiveness by activating quickly.

It is another object of this invention to produce a more reliable and economical signal device.

It is an object of this invention to provide a lighted marine signal device which will not experience lamp failure as a result of high impact shocks.

It is a further object of this invention to provide a signal device wherein the ballast weight moves to effect the switching function as the device is inverted.

It is another object of this invention to provide a signal device wherein the battery moves as the device is inverted to effect the switching function.

It is another object of this invention to provide a signal device wherein the battery acts as the ballast weight and the switch weight.

It is another object of this invention to provide a more reliable signal device by using the substantial weight of the batteries or ballast weight to effect the gravity switching.

It is another object of this invention to further improve the switching by providing a spring which increases the switch contact pressure and results in lower contact resistance.

It is a further object of this invention to provide a signal device which permits its user to quickly activate it and assure the operability at the time of deployment.

It is another object of this invention to alter the time of activation of the signal device by using a spring to supplement the gravitational forces which move the switch weight to activate the contacts.

It is a further objective of this invention to provide a signal device that can easily have its switching contacts replaced each time the battery is replaced.

It is another objective of this invention to provide a signal device that will not sink due to gasket failure.

It is another objective of this invention to reduce the number of components and the weight of the signal device by combining the functions of some of the separate prior art components.

BRIEF DESCRIPTION OF DRAWINGS

Other objects and advantages may be observed from the description when viewed in conjunction with the accompanying drawings wherein.

DETAILED DESCRIPTION OF THE INVENTION

Figure 1:
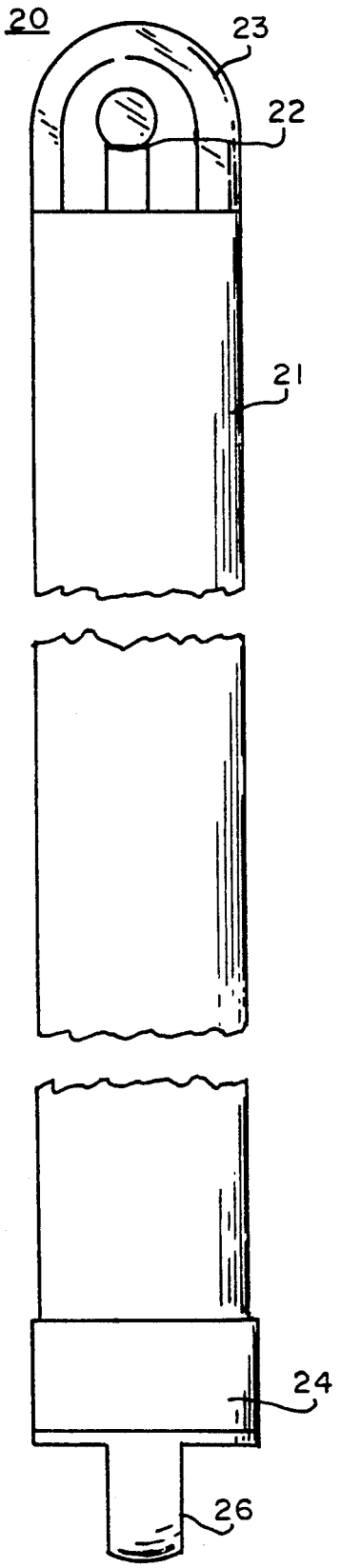
FIG. 1 is a compressed illustration of the marine distress signal device.

For personal rescue operations in rivers, lakes, and seas of persons overboard in the waters the probability of success is often dependent upon rapid deployment of reliable devices to aid the individual in jeopardy. Thus time and reliability are of the essence. The likelihood of successfully recovering the overboard person is greatly enhanced if the deployed life ring-float is accompanied by a floating signal device which assists both the swimmer and the rescuer in the effort. One standard device for such rescue efforts is the marine distress signal. This device normally emits electromagnetic energy in the visible spectrum by igniting a lamp which can be seen by all observers. However, some models emit nonvisible electromagnetic energy which can be used to locate the device by distant sensitive receivers. Many of the concepts detailed in this invention are applicable to designs regardless of the type of emitter incorporated.

The most common marine signal is one that emits visible light. It has been found that the standard lighting devices of the prior art pose operating problems that reduce their reliability. Many have design features that increase their cost. Normally the clear lens cover at the top of the light is sealed to the tubular body with a gasket. After use and elapsed time the gaskets can form defects which cause them to leak. When this happens waves passing over the deployed light cause it to fill with water and eventually sink. Also the automatic gravity switch incorporates an activating weight which is constantly moving as the ship rises and falls. The switch contacts that are actuated as a result of the moving weight are subject to many unnecessary operations.

As they are subjected to thousands of cycles, these switches eventually fail. This failure is either in the weight/passageway or contact portion of the switch. The passageway can wear or become distorted. The contacts can develop excess resistance due to oxidation or aging. Furthermore, since the switching mechanism is usually sealed within the circuit assembly, the switch cannot easily be repaired and the entire light or circuit must often be replaced.

The switching mechanism usually activates the contacts either with a weight of liquid mercury or a solid weight such as a ball or cylinder. Since the use of mercury is not currently acceptable for military applications, the solid weight design is normally used on military designs. In either case, size and weight restrictions on the entire signal device limit the weight of the switching mechanism. The limited switch weight limits the pressure applied to the contacts and because of this, the contact resistance is often higher than desirable. In addition, the contacts must be precision made of light gauge materials to assure that the small switch weight can move them into contact position.

Finally, because of the small switch weight and light gauge contacts within the switch small pieces of foreign matter, dirt or corrosion can easily result in switch failure.

Prior art has invested much effort to create attitude sensitive time delay switches to reduce on-off cycling due to ship motion. This was desirable as the light weight switch design was prone to failure especially after numerous activations. The time delay feature could almost eliminate repeated activations due to ship movement.

Unfortunately, the time delay feature has a negative facet. When the signal is being deployed, the user would like to be sure it is operating as he throws it into the water. In addition, in fast moving currents it is desirable that the person in the water see the signal quickly so that he may swim to it before he is out of range or is physically weakened by the exposure. The time delay feature works against both of these objectives.

The signal portion of this device would normally include either a radio locator beacon, lamp or both. When a lamp is incorporated prior designs have used both incandescent and Xenon strobe lamps. The incandescent lamp is less expensive than the Xenon strobe but because of the possibility of filament failure it is lacking in its reliability. The Xenon strobe lamp is substantially brighter and has no filament. However, it has a disadvantage in that its glass envelope is easily broken as a result of the shocks that the light is subjected to as part of its deployment. The glass envelope on the Xenon strobe lamp is large and fragile. Prior art has attempted to improve the ruggedness of the Xenon lamp design by embedding the base of the lamp in an elastomeric material. This procedure did improve but did not eliminate the bulb envelope failure problem. In addition, the elastomeric potting compound at the base of the lamp served to reduce the stability of the deployed light because it added weight at the top of the light. Other designs placed the lamp in a foam but had problems when the lamp is shifted, pulled on its wires and cracked. Attempts to prevent lamp shifting by using its wires to restrain it resulted in envelope fracture during shock as the wires exerted stress on the envelope.

A rigid foam was also used to encapsulate the base of the lamp but this did not do enough to prevent the transmission of shocks and also resulted in excessive failure.

My invention creates a signal device which will not sink due to gasket failure. The lamp cover is sealed to the tubular body and cannot leak. The battery cap permits the installation of the batteries and is sealed to the tubular body with an O-ring gasket. When deployed the battery/ballast orients the signal so that the lamp cover is above the water and the gasketed battery cap below. If the battery cap gasket was broken or even removed the signal device would not sink. Some water would enter the bottom of the device but since the trapped air could not escape the amount of entering water would be limited to an amount which would not alter the positive buoyancy of the signal. In rough seas, the signal would rotate from its vertical position creating the possibility that small amounts of air would escape each time the signal rotated. The cumulative loss of air could permit an unacceptable intake of water resulting in a major loss in buoyancy. This potential problem is mitigated by making a signal lamp that has a length to diameter ratio of at least 10 to 1 and which has improved stability because its switch weight is in the bottom ⅓ of the device. Because of its geometry and improved stability, this device would depart from its vertical position only a minimal amount and thus avoid the intake of water and resulting loss in buoyancy.

The batteries represent a substantial percentage of the weight of the deployed signal. For that reason, they have frequently been used as ballast, but in some prior designs additional weights have been incorporated at the bottom of the signal device for required stability with enough buoyancy to raise the lamp above water level. In order to maximize stability, the additional ballast was firmly fixed at the bottom of the signal device. Because the ballast concentrates weight at the bottom of the assembly, the force usually applied at the center of the device by the hand of the person throwing it into the water creates a spin or rotation. A rotating device is more prone to damage as it enters the water than similar devices which can slide into the water because they are not rotating.

My invention improves the survivability of the signal by locating the batteries closer to the center of the body of the device during storage. However, once the device is in the water, the batteries shift position downward within the submersible end of the device 20 to improve and maintain the device's vertical stability. The batteries must always be positioned to effect some righting moment to assure that the device rotates to the vertical position regardless of how it enters the water. The shifting of the batteries simply improves the stability when the device is deployed.

Permitting the battery or ballast to move can also result in other improvements in the signal device. The battery represents a substantial portion of the weight of the device. If the battery shifts when the device is inverted, the shifting movement can be used to activate the electric switch. The switch activation time can be increased or decreased by the inclusion of a coiled spring which can be positioned to exert a force on the battery to decrease or increase its downward acceleration. A switch activated by the heavy battery or ballast would be capable of developing higher switch contact pressure resulting in lower switch contact resistance than prior art. In addition, the increased forces available in this design would permit the switch to be designed to clear itself of foreign matter. The design can be further improved if the battery itself becomes a switch contact. In this instance, each time the batteries are replaced, the switch contact is replaced. Thus there is less possibility of switch contact failure due to oxidation. In some designs it may be desirable to place the battery in a holder. This holder would include the other half of the switch contact and would permit both halves of the switch contact to be replaced during routine maintenance.

If the batteries used in the device have a specific weight exceeding 1.3 oz./cu.in.additional advantages relating to the design concept are realized. First the movement of the center of gravity due to the shifting of batteries is more pronounced and thus more effective. Second when used as a switch weight, the batteries are less prone to frictional drag and potential failure. Batteries such as carbon zinc, which have lower specific weights and more surface area for a given weight are less reliable.

Furthermore, if alkaline batteries with specific weights exceeding 1.3 oz./cu.in. are used in the device and the length to diameter ratio exceeds 10 to 1, it is also possible to totally eliminate the conventional ballast weight.

In order to improve the ruggedness of the signal device, the lamp is supported by cellular foam. On designs which incorporate a lamp assembly including a lamp and socket adhesive is used to secure the lamp to the socket or socket to foam. In other designs such as those using a Xenon strobe lamp, the base of the envelope of the lamp is glued to the cellular foam. This design creates a product which can withstand very substantial shocks. Since the Xenon lamp envelope is glued to the cellular foam, there is minimum strain at the point where the wire enters the envelope. In addition, the foam is substantially more flexible than a solid elastomeric material and this flexibility absorbs major shocks without bulb damage.

Finally, the flexible cellular foam lamp support has a low specific gravity and therefore does not negatively affect the stability of the signal device. The foam also serves to guarantee the buoyancy of the signal device because it prevents the device from filling with water under all conditions. In my configuration the cellular foam can also support the circuit board and prevent it from shock damage as well. The use of an adhesive to attach the lamp to the flexible foam achieves maximum shock resistance for the design. The flexible foam prevents transmission of outside shocks and returns to its original dimension after impact. The adhesive connecting the lamp to the flexible foam assures that the lamp is prevented from movement in a way that prevents the wires from damaging the lamp.

Now in reference to the drawings, FIG. 1 shows the marine distress signal device 20 to be assembled in an elongated tube 21 having a light source 22 located approximately on the axis at the end of the tube 21. The lamp is enclosed within a sealed waterproof transparent optical lens 23. Depending upon wave action when deployed the light source 22 rides above the water surface to provide light to the swimmer for an indication of the location of a rescue float. At the opposite end of the elongated tube 21 a removable end cap 24 provides a means of access for the insertion of batteries 25, FIGS. 1–3, and such ballast weight as may be necessary to cause the signal device 20 to seek a vertical orientation with the end cap 24 beneath the water surface line when deployed. The end cap 24 has an integral D-ring 26 to which a rescue float device may be tethered by a suitable cord to prevent the drifting apart of the signal device 20 and the rescue platform.

Figure 2:
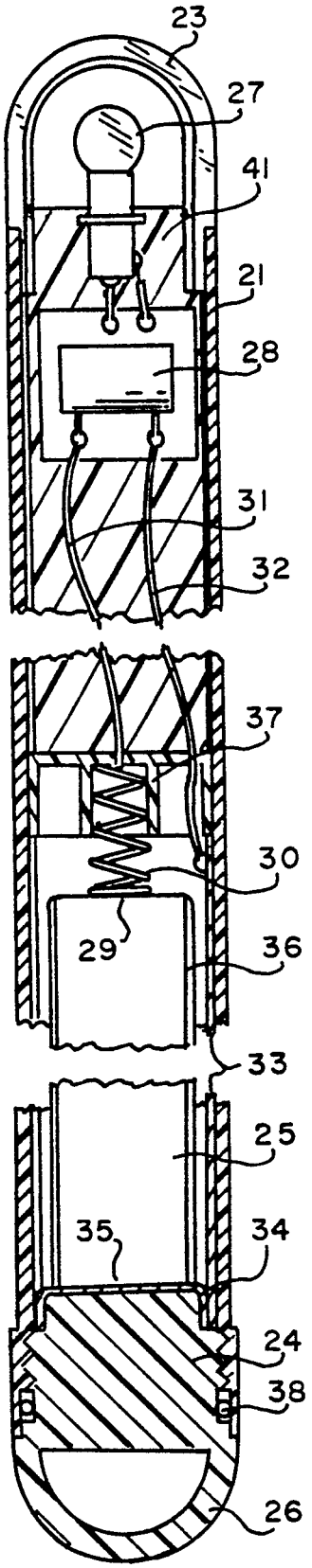
FIG. 2 is a compressed longitudinal cross sectional illustration of the marine distress signal device as shown in the upright operating orientation with the battery engaging electrical contacts to activate the signal lamp.
Figure 3:
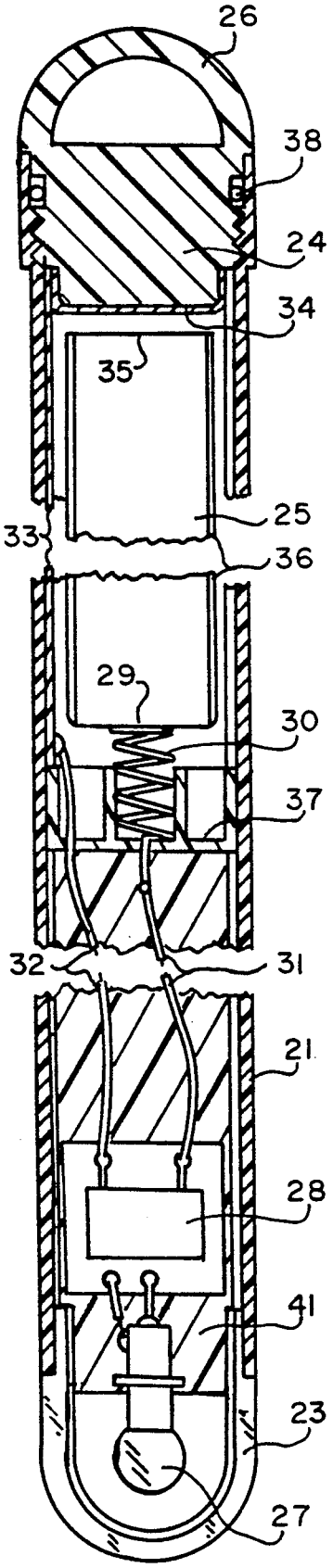
FIG. 3 is a compressed longitudinal cross sectional illustration of the device shown in the inverted nonoperative orientation for stowage aboard ship wherein the battery location has shifted to open the electrical circuit to the signal lamp.

The cross-sectional views of FIGS. 2 and 3 are illustrative of my invention as embodied in a design incorporating an incandescent lamp 27 for the light source 22. FIG. 2 is illustrative of the device 20 when deployed in the water, while FIG. 3 is illustrative of the stowed orientation (in a suitable bracket, not shown) aboard ship. The incandescent lamp 27 may be controlled by an electronic circuit 28 to produce a flashing light source 22.

A closed electrical circuit for activating the incandescent lamp 27 is seen in FIG. 2 extending from the positive battery terminal 29 through the coiled spring 30, conductor 31, circuit 28, the filament of the lamp 27, return conductor 32, conducting sleeve 33, base conducting contact 34, to the return casing contact 35 of the battery 25 which is contained in an insulating sleeve 36. Except for the conducting spring 30 and the battery 25 all of the assembled elements of the device 20 are stationary relative to the elongated tube 21. When the device 20 is deployed, as in FIG. 2, the force of gravity, supplemented by the action of the coiled spring 30, moves the battery 25 downward to engage the battery return casing 35 with the base conducting contact 34 thereby effecting an automatic switching action with reduced contact resistance to activate the light source 22.

But when the device 20 is stowed aboard ship in the inverted position as shown in FIG. 3 the force of gravity upon the mass of the battery 25 is sufficient to compress the coiled spring 30 and allow the battery 25 to drop downward disengaging the contact between the battery return casing 35 and the base conducting contactor 34, thereby breaking the electrical circuit for an off-status of the light source 22. The strength and length of the conducting coiled spring 30 is sufficient to always maintain contact with the positive battery terminal 29 throughout the full movement of the battery 25 but when stowed, as in FIG. 3, the mass of the battery 25, under the force of gravity, compresses the length of the spring 30 to open the electrical circuit.

The functioning of the device depends upon the reliable movement of the battery. The gravitational forces which cause the movement are opposed by the frictional forces between the battery and the tubular wall. These frictional forces must be minimized to assure that they are always less than the gravitational forces. The frictional forces are decreased if the battery is small in size or has a high specific weight. Therefore, the reliability of the device is greatly improved if the specific weight of the battery exceeds 1.3 oz/cu.in. Thus normal carbon zinc batteries with a low specific weight of approximately 1.1 oz./cu.in. reduce the reliability of the device. Alkaline batteries which can have a specific weight of approximately 1.4 oz./cu.in. perform especially well. The frictional forces are also reduced if the jacket of the battery is metallic as the coefficient of friction between the battery and wall will be less than batteries with jackets of fibrous materials.

Metallic jackets will also not easily swell and change their dimensions and frictional characteristics. High specific weight batteries with metal jackets will assure reliable movement and switching. In addition, if the ballast weight is incorporated into the battery, the device operates longer, is more compact, switches reliably, and is less expensive to manufacture.

The circuit base and spring retainer 37 is rigidly attached as a bulkhead to the tube 21, FIGS. 2 and 3. The transparent lens 23, while optionally removable for lamp 27 replacement, is usually permanently sealed to the tube 21. The cap 24, removable for battery and switch maintenance, is sealed against water infiltration within the tube 21, by the threaded construction and the O-ring 38.

Figure 4:
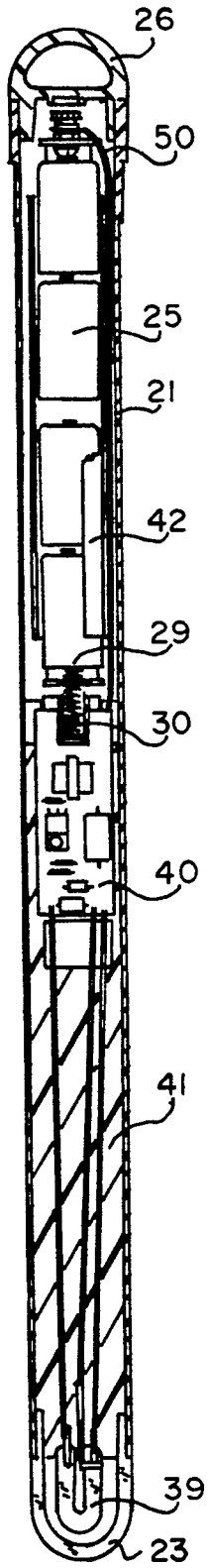
FIG. 4 is a cross sectional view of the distress signaling device which contains the Xenon flashtube lamp and moving battery activating switch components.
Figure 5:
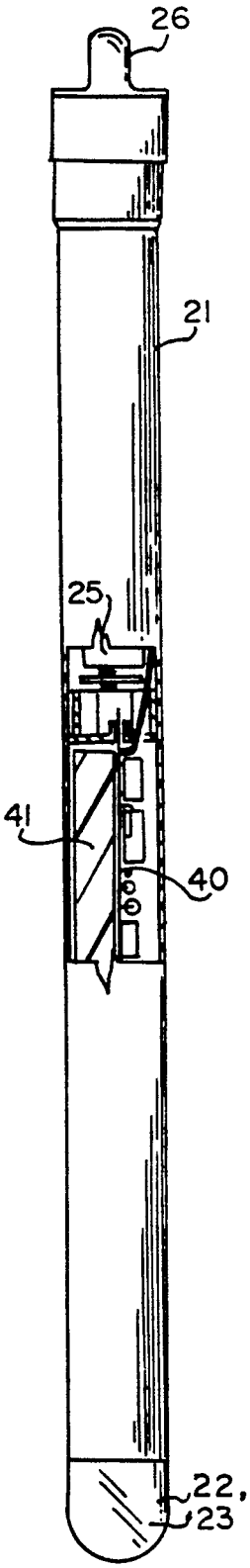
FIG. 5 is a partial cross sectional view of the distress signaling device illustrating the cellular foam support for the Xenon flashtube and printed circuit components.
Figure 6:
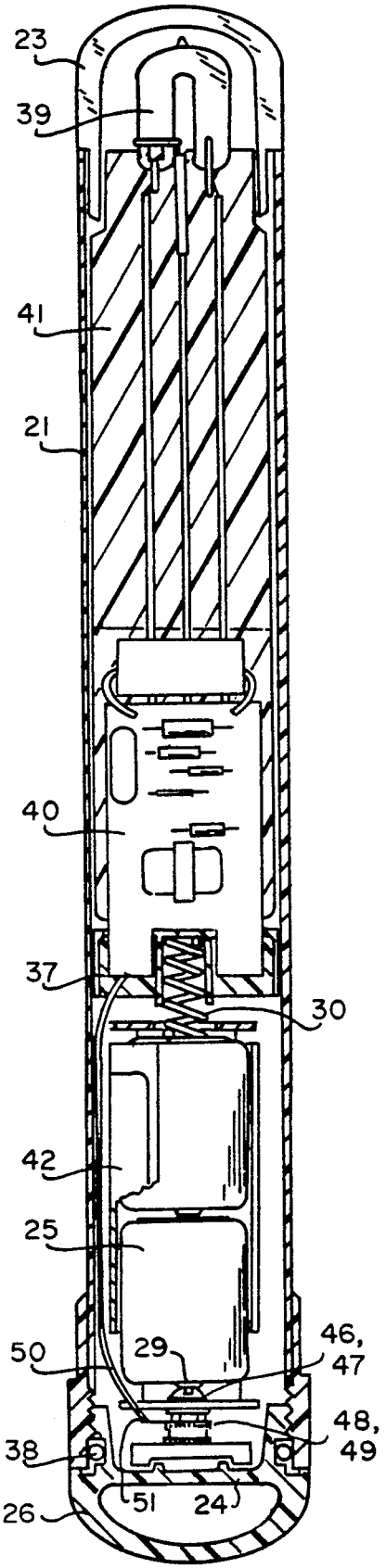
FIG. 6 is a further cross sectional view of the distress signaling device illustrating the battery magazine and electric circuit contacts and the Xenon flashtube mounting.

The preferred embodiment of my invention is illustrated in FIGS. 4–6. For reliability and luminous intensity the light source 22 utilizes a Xenon flashtube lamp 39 and conventional driving circuits 40, which are secured within the tube 21 and protected from shock and vibration by absorbing material typically cellular foam 41 which also insures the buoyancy and vertical stability of the device 20 when deployed in the water. The base of the Xenon lamp 39 is glued to the shock absorbing foam 41. The driving circuit board 40 is assembled to the circuit base 37 which coaxially retains the coiled conducting spring 30 which contacts the positive battery terminal 29. The circuit base or bulkhead 37 is rigidly fixed to the tube 21 to hold the Xenon lamp 39, the driving circuit board 40 and the supporting cellular foam 41 stationary within the tube 21.

FIGS. 4 and 6 illustrate that a number of dry cell batteries 25 are contained in an optional resilient magazine or clipholder 42 that is inserted and is removable from the elongated tube 21 when the end cap 24 is removed. The overall length of the magazine 42 exceeds the cumulative length of the batteries 25 which allows axial movement of the batteries 25 as previously described above with respect to FIGS. 1-3 for automatically activating the light source 22 upon deployment in the water, the force of gravity supplemented by that of the coiled spring 30 performing the switching function.

Figure 7:
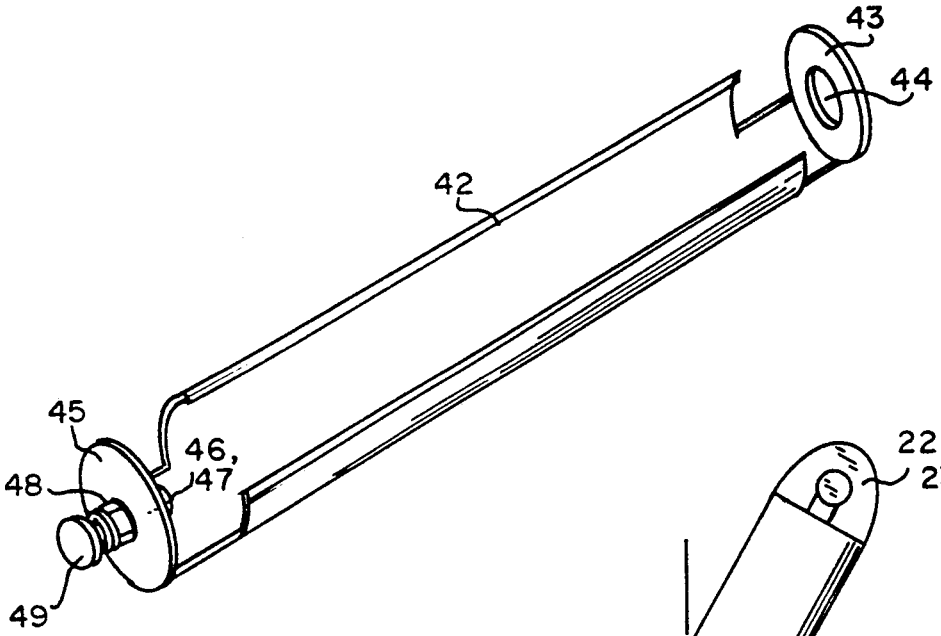
FIG. 7 is a perspective view of the emptied battery magazine.
Figure 16:
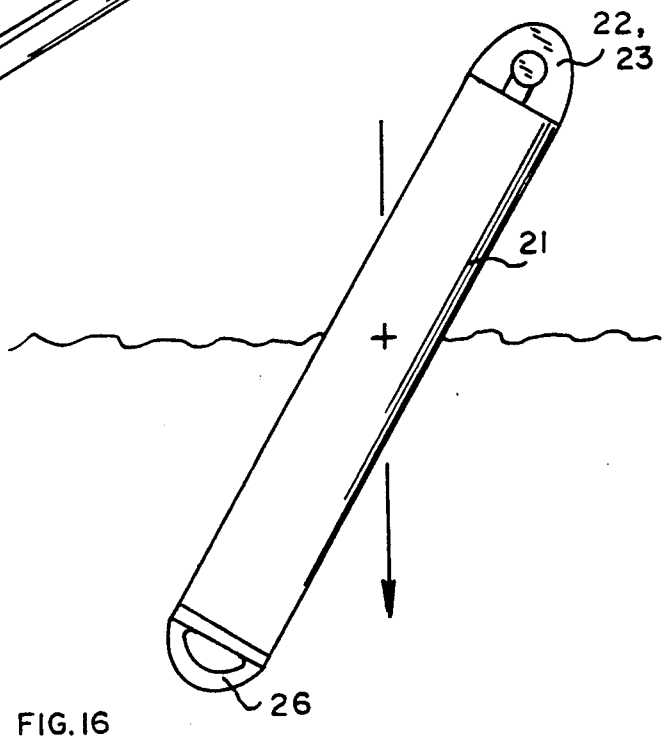
FIG. 16 illustrates deployment of the signal device in water.

The emptied battery magazine 42 is further illustrated in FIG. 7. The elongated battery magazine clip 42 is made of a resilient non-conductive material that allows insertion or removal of each cylindrical battery through the longitudinal opening of the central section which is a cylindrical sector in the range of 200 to 240 degrees of the magazine circumference. Transversely projecting battery stops are provided at each end of the magazine 42. As assembled in the signal device 20 the inner stop 43 contains a coaxial aperture 44 through which the conductive coiled spring 30 projects to make contact, in this embodiment, with the battery return casing 35. At the outer transverse stop 45 a coaxial conducting terminal 46 is assembled therein for contact, when the device 20 is deployed in the water, with the battery positive terminal 29. The coaxial terminal 46 is merely a small conducting machine screw 47, coaxially secured to the outer stop 45 by a hex nut 48, with sufficient length of the screw 47 to accommodate an additional thumb nut 49. A flexible wire conductor 50 extends from the Xenon lamp circuit board 40 past the battery magazine 42 for connection to the coaxial terminal 46. The flexible conductor 50 terminates in a flag connector 51 which (after insertion of the battery loaded magazine) is assembled to the terminal 46 between the hex 48 and thumb 49 nut. Assembly of the signal device 20 is then completed by attachment of the threaded end cap 24 which carries an O-ring for sealing the tube 21 from water infiltration.

As the signal device 20 is thrown overboard into the water the weight of the batteries irrespective of their exact position in the magazine 42 is sufficient to erect the device 20 vertically to put the light source 22 above the water line. To the greatest extent possible dead ballast weight is eliminated in favor of additional battery weight for the best reliability and deployed life of the device 20.

Figure 8:
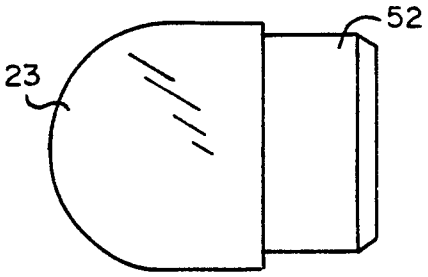
FIG. 8 is a side view of the light emitting lens.
Figure 9:
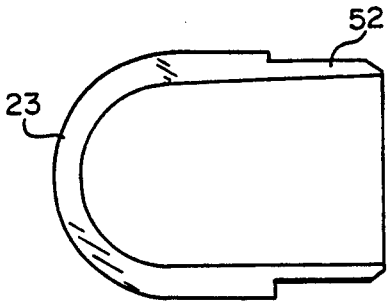
FIG. 9 is a cross sectional view of the light emitting lens.

The transparent lens 23 of the light source 22 is illustrated in FIGS. 8 and 9. Its shank 52 is sized to fit tightly within the elongated tube 21 to which it is bonded for permanent attachment.

Figure 10:
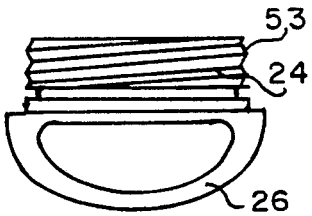
FIG. 10 is a side view of the removable battery compartment end cap.
Figure 11:
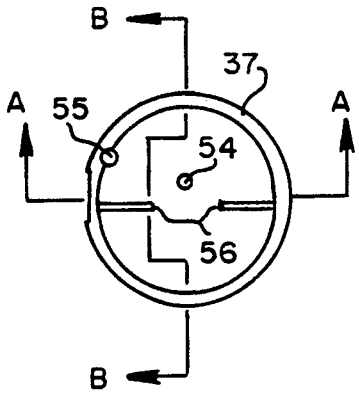
FIG. 11 is a top view of the circuit board retaining base.
Figure 12:
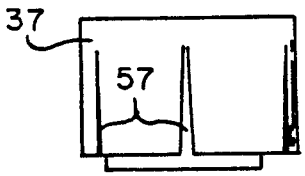
FIG. 12 is a side view of the circuit board retaining base.
Figure 13:
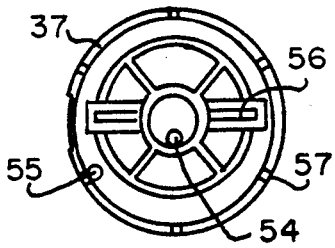
FIG. 13 is a bottom view of the circuit board retaining base.
Figure 14:
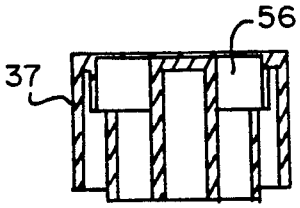
FIG. 14 is a cross section view of the circuit board retaining base along lines A—A of FIG. 11.
Figure 15:
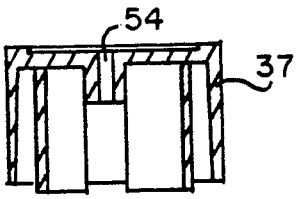
FIG. 15 is a cross section view of the circuit board retaining base along lines B—B of FIG. 11.

A side view of the removable end cap 24 showing the O-ring 38, the cap D-ring 26, and threads 53 is seen in FIG. 10. The nonconducting circuit base 37 is illustrated in FIGS. 11-15. Feedthrough apertures 54 and 55 for the coiled spring 30 and wire conductor 50 respectively are seen in FIGS. 11 and 13. Slots 56 for receiving tabs of the Xenon Circuit driver board 40 are seen in FIGS. 11, 13 and 14.

To maintain vertical stability of the deployed signal device 20 in the presence of typical wave action where rescue attempts are practical the ratio of the length of the tube 21 to its diameter has been determined to be at least 10 to 1 in ratio of dimensions. Except for the electrical components noncorrosive materials are preferred for the marine signal device 20.

Having described my invention and its operation by illustrations it should be understood that modifications are possible without departing from the invention the scope of which is set forth in the following appended claims.

I claim:

1. An elongated marine signaling device in a tubular housing which may be deposited to float erect in a body of water to identify a location by emission of an omnidirectional light above the prevailing water line from a lamp, wherein the improvement comprises:

a) a battery power supply for said lamp;

b) means for the automatic movement of said battery power supply to a first location within the elongated tube of said signaling device below that location required for erection upon deployment in said body of water to effect a lower center of gravity for accelerating erection and for vertical stability of said signaling device in the presence of wave motions in said body of water;

c) means responsive to downward gravitational force acting upon the mass of said battery power supply and the counteracting upward buoyancy force acting upon said signaling device for an automatic closure of the contacts of an electrical switch to apply battery power to said lamp;

d) means for the automatic movement, responsive to said gravitational force, of said battery power supply to a second location within said signaling device upon stowage aboard ship with said lamp positioned below said battery power supply, for opening said automatic electrical switch for extinguishing said lamp throughout a wide range of roll and pitch motions of said ship; and e) a spring under compression, said spring, firstly, for supplementing said gravitational force upon said battery power supply when said signaling device is deployed in said body of water for acceleration and reduction of the time for erection and lamp activation of said signaling device with continuous application of spring force in cooperation with said gravitational force for increased pressure between said contacts for reliable closure of said automatic electrical switch; said spring, secondly, when said signaling device is stowed aboard ship in an inverted orientation, for opposing said gravitational force upon said battery power supply to support said battery power supply while said contacts of said automatic electrical switch are opened to deactivate said lamp.

2. An elongated marine signaling device, as recited in claim 1, wherein said automatic switch comprises:

a) a moving contactor which comprises a first electrical terminal of a battery of said battery power supply;

b) a companion stationary contractor for engagement with said moving first battery terminal;

c) a continuous conductor extending from said companion stationary contractor to a central circuit for said lamp; and d) means for reciprocal removal of said battery power supply and said companion contractor from the submersible end of said elongated signaling device for full inspection and maintenance of said automatic switch and said batteries.

3. An elongated marine signaling device, as recited in claim 2, wherein ad stationary contractor of said automatic electric switch comprises:

a) a conductive covering for the inner surface of a removable cap that closes said submersible end of said elongated signaling device.

4. An elongated marine signaling device, as recited in claim 2, wherein the improvement further comprises:

a) a reciprocally removable magazine clip holder for containing said battery power supply; and b) a coaxial terminal fixed in a first end of said battery power supply magazine clip holder for said companion stationary contractor of said automatic electric switch.

5. An elongated marine signal device as recited in claim 1, or claim 4, wherein said improvement further comprises:

a) a filler of cellular material interposed between said lamp and said tubular housing for the isolation of said lamp from impact shock; and b) a bulkhead rigidly attached to said housing for dividing the interior cavity of said housing into first and second compartments, said first compartment for enclosing said lamp and said shock isolating cellular material, said second compartment for enclosing said battery power supply, said bulkhead for confining said movement of said battery power supply from impact upon said cellular material and lamp combination.

6. An elongated marine signal device as recited in claim 1, or claim 4, wherein said improvement further comprises:

a) a driving circuit for said lamp; and b) a filler of low density cellular foam interposed between said lamp and said circuit and said tubular housing for the isolation of said lamp and circuit from impact shock; and c) a bulkhead rigidly attached to said housing for dividing the interior cavity of said housing into first and second compartments, said first compartment for enclosing said lamp, said circuit and said cellular foam, said second compartment for enclosing said battery power supply, said bulkhead for confining said movement of said battery power supply from impact upon said cellular foam, said circuit, and said lamp combination.

7. An elongated marine signaling device, as recited in claim 1, or claim 4, wherein the improvement further comprises:

a) said elongated tube, further comprising:

a first interior cavity for housing therein said lamp and associated electrical driving circuits; and a second interior cavity for housing therein said battery power supply;

b) means for preventing infiltration of water when said signaling device is deployed in water; and c) a filler of flexible non-absorbing low specific gravity material for a substantial portion of said first cavity for maintaining buoyancy and erection stability of said signaling device in the event of damaging failure of said elongated tube.

8. An elongated marine signaling device, as recited in claim 7, wherein said means for preventing infiltration of water within said device comprises:

a) said elongated tube for housing said signaling device having a length to the maximum cross section dimensional ratio of at least ten to one; and for vertical stabilization of said device shown deployed in turbulent waters to retain trapped air and inhibit entry of water in said first and second cavities; and b) a gasket interposed between the end of said elongated tube that is submerged when said device floats in water and a removable end cap that closes said second cavity containing said power supply, for sealing said device from entry of water.

9. An orientation sensitive battery power supply for automatic activation of an electric powered device, wherein the improvement comprises:

a) at least one battery having coaxial positive and return electrical contact terminals at opposing ends of said battery;

b) a loosely fitting enclosure for said battery power supply having an axial length in excess of the aggregate length of said battery;

c) a first coaxially located current conducting contact terminal in a first end of said enclosure for receiving the first coaxial output terminal of said battery upon downward movement of said battery power supply;

d) a coaxially located current conducting coiled spring at the second end of said enclosure for continuous forced contact with the second output terminal of said battery at any spatial orientation;

e) means for the compression of the length of said coiled spring by the aggregate mass of said battery power supply for withdrawal of said first battery output terminal from said first coaxial contact terminal for extinction of current flow in external circuits when in an inverted nonoperating orientation; and f) means for closing said first battery output terminal upon said first coaxial contact terminal or activation of current flow in said external circuits responsive to the combined forces of said coiled spring and of gravity acting upon said power supply when in a floating erected operating orientation.

10. An elongated marine signaling device for deposit in a body of water to float vertically upright for signaling a location by emission of omni-directional light from a lamp held by said floating device above the prevailing water line, which comprises:

a) an elongated tubular housing having a length to the maximum transverse cross-section dimensional ratio of at least ten to one, comprising:

a first compartment within the exposed end of said tubular housing when floating in water;

a second compartment within the submerged end of said tubular housing when floating in water; and an interior bulkhead for separating said first and second butler compartments;

b) an extending clear transparent lens for closing and sealing the uppermost end of said tubular housing when floating in water;

c) an incandescent lamp fixture for emitting said omni-directional light through said lens;

d) a reciprocally removable cap for closing and sealing the submerged end of said tubular housing when floating in water;

e) an insertable and removable power supply contained within said second compartment, which comprises:

at least one dry cell battery, coaxially and loosely positioned within said second compartment, said battery comprising coaxial positive and return electrical terminals on opposing ends of said battery;

the aggregate length of said battery and of multiple batteries in series arrangement is less than the length of the longitudinal axis of said second compartment;

a coiled current conducting spring interposed and compressed coaxially between an output terminal of said series of batteries and said interior housing bulkhead for continuous connection to the circuit of said lamp;

a conductive interior cap surface for contact with the return terminal of said series of batteries;

a conductor of current extending from said interior cap surface to said lamp circuit;

f) automatic means for activating current flow from said power supply to said lamp responsive to physical forces of said compressed spring and of gravity in moving said series of batteries to engage said return terminal of said power supply with said conductive cap surface when said signaling device floats vertically uprignt in water; and g) automatic means for extinguishing said current flow from said power supply to said lamp responsive to gravitational force upon the mass of said series of batteries in further compressing the length of said coiled conductive spring for separating said power supply return terminal from said conductive cap surface when said signaling device is inverted and stowed with said power supply above said lamp fixture.

11. An elongated marine signaling device for deposit in a body of water to float vertically upright for signaling a location by emission of omni-directional light from a lamp held by said floating device above the prevailing water line, which comprises:

a) an elongated tubular housing having a length to transverse cross-sectional dimensional ratio of at least ten to one, comprising:

a first compartment within a first end of said tubular housing that is exposed when floating in water;

a second compartment within a second end of said tubular housing that is submerged when floating in water; and an interior bulkhead for separating said first and second tubular compartment;

b) an extending clear transparent lens for closing and sealing said first compartment against entry of water;

c) a reciprocally removable cap for closing and sealing said second compartment against entry of water;

d) a Xenon flashtube lamp fixture for emitting pulses of said omni-directional light through said extending transparent lens;

e) a buoyant and shock absorbing filler interposed between said Xenon flashtube fixture and the inner walls of said tubular housing for support of said flashtube fixture, for absorption of impact shocks and vibration, and for sustained buoyancy should water leak into said first compartment;

f) an insertable and removable power supply contained in said second housing compartment which comprises:

a non-conductive magazine clip for loosely holding a dry cell battery, said clip comprising:

a sector in the range of 200 to 240 degrees of a cylindrical casing of resilient material having a longitudinal length exceeding the aggregate length of said multiplicity of batteries arranged in series combination;

a ring stop appendage of said magazine clip projecting orthogonally from a first end of said cylindrical casing sector with the aperture of said ring stop concentric about the longitudinal axis of said casing sector; and an electrical contact appendage of said magazine clip projecting orthogonally from a second end of said cylindrical casing sector comprising a fixed coaxial electrical contact and terminal junction;

said dry cell battery with positive terminal directed toward said fixed coaxial magazine contact and terminal junction;

g) an electrically conductive coiled spring extending along the axis of said tubular housing from said interior bulkhead to project through said aperture of said magazine ring stop for continuous contact under compression with the return negative terminal of the adjacent battery of said power supply when assembled in said signaling device;

h) means for connecting said coiled spring and said magazine electrical contact and terminal junction to said Xenon lamp fixture;

i) means for automatic activation of current flow from said power supply to said Xenon lamp fixture responsive to complementary forces of said coiled spring and gravity acting to move said battery for contact with said magazine electrical contact when said signaling device floats and erects vertically in said body of water; and j) means for automatic extinction of current flow from said power supply to said Xenon lamp fixture responsive to said gravitational force upon the mass of said multiplicity of batteries in further compressing the length of said coiled spring and separating said positive battery terminal from said magazine contact terminal when said signaling device is inverted and stowed aboard ship with said power supply above said Xenon lamp fixture.

12. An elongated marine signal device including a lamp or lamp assembly, battery and tubular housing, designed to float in water and identify its location wherein the improvement comprises:

a) a Xenon lamp;

b) flexible cellular foam supporting said lamp interposed between said lamp and the interior wall of the tubular housing;

c) an adhesive mechanically securing said lamp or lamp assembly to said cellular foam to prevent shifting of said lamp relative to said cellular foam;

d) a driving circuit for said lamp; and e) a filler of flexible, low density cellular foam interposed between said circuit and the interior wall of the tubular housing for the isolation of said circuit from impact shock.

13. An elongated marine signal device including a lamp or lamp assembly, battery, and tubular housing, designed to float in water and identify its location wherein the improvement comprises:

a) an incandescent lamp;

b) flexible cellular foam supporting said lamp interposed between said lamp and the interior wall of the tubular housing;

c) an adhesive mechanically securing said lamp or lamp assembly to said cellular foam to prevent shifting of said lamp relative to said cellular foam;

d) a driving circuit for said lamp; and e) a filler of flexible, low density cellular foam interposed between said circuit and the interior wall of the tubular housing for the isolation of said circuit from impact shock.

14. An elongated marine signal device designed to float erect in a body of water to identify its location wherein the improvement comprises:

a) means to emit electromagnetic energy;

b) a battery power supply;

c) an automatic switch responsive to erection of said device in said water for said power supply;

d) said switch comprising a movable solid weight, said weight positioned to be acted upon by gravitational forces to effect activation of said switch; and e) a conducting spring in the electrical circuit of said lamp for exerting a force firstly upon said weight to alter the activation time of said switch by supplementing said gravitational forces during the initial deployment of said signal device; secondly, upon said weight to reduce the electrical resistance of said switch throughout the period of deployment in said body of water; and thirdly, upon said weight in opposition to said gravitational forces to reduce impact shocks when said signal device is stowed in an inverted orientation aboard ships.

15. A signal device as described in claim 14 wherein said switch comprises a terminal of said battery power supply.

16. A signal device as described in claim 14 wherein said means to emit electromagnetic energy is a lamp.

17. A signal device as described in claim 14 wherein said battery power supply is said switch weight.

18. A signal device as described in claim 17 wherein batteries of said battery power supply have a specific weight exceeding 1.3 oz./cu.inch for compressing the length of said conducting spring where said device is stowed aboard ship in the inverted orientation for enabling the opening of said automatic gravity actuated switch for extinguishing said emission of electromagnetic energy.

19. A signal device as described in claim 17 wherein batteries of said battery power supply have metal jackets for stabilizing frictional forces between said battery power supply and an enclosing magazine for reliable movement of said batteries, responsive to said gravitational forces, to effect reliable operation of said automatic gravity activated switch and to assure accelerated vertical erection of said device when initially placed in water.

20. A signal device as described in claim 14 which further includes:

a) an elongated tubular housing having a length to the largest transverse cross-sectional dimensional ratio of at least ten to one, comprising:

a first compartment within a first end of said tubular housing that is exposed when floating in water;

a second compartment within a second end of said tubular housing that is submerged when floating in water;

b) an extending clear transparent lens for closing and sealing said first compartment against entry of water, said lens bonded to said tubular housing; and c) a reciprocally removable cap and gasket for closing and sealing said second compartment against entry of water.

21. An elongated marine device for deposit in a body of water to float vertically upright for signaling a location by emission of electromagnetic energy, comprising:

a) en elongated tubular housing comprising;

a first compartment within the first end of said tubular housing that is exposed above the surface when floating in said water;

a second compartment within the second end of said tubular housing that is submerged below said surface when floating in said water;

an interior bulkhead at an intermediate location within said tubular housing for separating said first and second tubular compartments; and b) a circuit and an emitter of electromagnetic energy within said first compartment;

c) an insertable and removable power supply contained within said second compartment for energising said circuit and emitter which comprises:

at least one dry cell battery, coaxially and loosely positioned within said second compartment, said battery comprising coaxial positive and return electrical terminals on opposing ends of said battery;

the aggregate length of said battery end of multiple batteries in series arrangement is less than the length of the longitudinal axis of said second compartment wherein said difference in lengths is for a longitudinal shifting of said batteries within said second compartment, to effect a change in the center of gravity of said signal device; and a coiled spring interposed coaxially between an output terminal of said series of batteries and said interior bulkhead, said spring positioned to compress and exert a physical force upon said battery in opposition to gravitational forces whenever said gravitational forces cause movement of said battery towards said bulkhead.

* * * * *